US005941398A

United States Patent [19]

Harris

[11] Patent Number: 5,941,398

[45] Date of Patent: Aug. 24, 1999

[54] FOLDABLE LOG RACK AND METHOD

[76] Inventor: David A. Harris, 7508 Brantley Gordon Rd., Denton, N.C. 27239

[21] Appl. No.: 09/009,340

[22] Filed: Jan. 20, 1998

[51] Int. Cl.[6] ..... A47F 5/00

[52] U.S. Cl. ..... 211/60.1; 211/49.1; 211/195; 211/198

[58] Field of Search ..... 211/60.1, 49.1, 211/195, 182, 198, 194

[56] References Cited

U.S. PATENT DOCUMENTS

| | | | |
|---|---|---|---|
| D. 357,827 | 5/1995 | Schultz | 6/462 |
| 2,699,911 | 1/1955 | Chase et al. | 211/194 X |
| 2,956,763 | 10/1960 | D'Arca | 211/195 X |
| 3,216,585 | 11/1965 | Whittle | 211/60.1 |
| 3,797,349 | 3/1974 | Smith | 83/404 |
| 4,326,731 | 4/1982 | Woychio et al. | 211/198 X |
| 4,535,896 | 8/1985 | Evenson | 211/195 X |
| 4,600,108 | 7/1986 | Scott et al. | 211/60.1 X |
| 4,616,757 | 10/1986 | Hobson | 211/60.1 X |
| 4,678,170 | 7/1987 | Sampson | 269/296 |
| 4,765,491 | 8/1988 | Mueller | 211/49.1 |
| 5,439,152 | 8/1995 | Campbell | 211/195 X |
| 5,484,150 | 1/1996 | Yasutomi | 211/182 X |
| 5,692,625 | 12/1997 | Filipescu et al. | 211/194 X |
| 5,743,413 | 4/1998 | Noll | 211/60.1 |

*Primary Examiner*—Robert W. Gibson, Jr.

[57] ABSTRACT

A foldable steel log rack which includes a rectangular base and four foldable standards. The standards have tapered terminal ends so that the logs may be inserted more easily. Locking pins are provided to rigidly hold the standards in the extended upright position. A method of using the same includes transporting the log rack to a desired location with the standards in a collapsed state, unfolding and securing the standards an extended position, and then loading logs or trimmed tree trunks therein as desired.

12 Claims, 3 Drawing Sheets

FOLDABLE LOG RACK AND METHOD

BACKGROUND OF THE INVENTION

1. Field of the Invention

This invention pertains to a rack for holding logs, which includes corner posts or standards which collapse for convenience in storage and in transportation.

2. Description of The Prior Art And Objectives Of The Invention

The lumber industry has always faced the problem of properly storing trimmed trees prior to transportation from the logging area to the mill. Likewise, at the mill, similar storage problems arise while logs and tree trunks wait to be processed; Storage on the ground may entail placing the logs in a mud churned yard where moisture and insects may induce rot and decay into the wood thereby rendering it unsalable. Storage sheds may be used at the mill, along with concrete pallets to remove the logs from close proximity to these decay inducing vectors, but such approaches are expensive, unmovable and certainly impractical at the actual logging site.

With these concerns in mind, it is an objective of the present invention to provide a sturdy, portable log rack which is well suited for holding tree trunks or large logs.

It is a further objective of the present invention to provide a log rack with foldable standards to facilitate the portability of the log rack.

It is yet a further objective of the present invention to provide a log rack which is simple and inexpensive to build.

It is still a further objective of the present invention to provide a log rack which is strong and durable despite extended, heavy use.

It is another objective to provide a log rack which prevents logs from dangerous, excessive rolling.

It is yet another objective to provide a convenient storage rack while logs wait to be loaded onto a truck or other vehicle.

It is still another objective to provide a log rack which allows different species of wood to be stacked separately, without large additional expense or components.

It is a further objective to provide a method for using a foldable log rack which implements these other objectives.

These and other objectives and advantages will become more apparent to those of ordinary skill in the art upon closer reference to the drawings and the accompanying detailed description.

SUMMARY OF THE INVENTION

A foldable steel log rack which is easily transported is provided, which comprises a base of three transverse tubular steel members in parallel and two longitudinal tubular steel members perpendicularly affixed to the transverse tubular members. The tubular steel members are preferably commercially available 5"×5" (12.7 cm×12.7 cm) square steel tubes, although other dimensions are possible. Pivotally attached to the longitudinal members are four triangular plates, one on each corner. The plates are preferably one half inch or 1.27 cm thick steel plates.

Welded to each triangular plate is a steel tubular standard. Each standard is preferably nine or ten feet (2.74 or 3.048 m) in length. Each standard includes a tapered terminal end to facilitate the positioning of trimmed tree trunks therein. The rack is preferably 10 or 20 feet (3.048 or 6.096 m) in length. Each triangular plate also defines a locking hole for receiving a locking pin. The locking pins extend through the triangular plates and into the base to hold the standards in the desired extended or upright position. While vertical positioning of the standards is preferred, other arrangements are possible, such as outwardly slanted standards, so that the log rack looks like a trapezoid from any side. This arrangement could allow for greater ease in placing logs in the rack, but would require additional support due to the increased forces applied to the standards. Since each plate is pivotally attached to the base, each standard may be lowered into a folded position against the base. This allows the size of the log rack to be reduced for transportation or when not in use.

In use, the log rack is transported by truck in the folded position to a desired location, and placed on the ground. The standards are rotated or raised to their extended positions and the locking pins are inserted to hold the standards in the extended or upright position. The trimmed logs or tree trunks can then be placed on the log rack to the approximate height of the standards. The logs remain until it is desired to load the logs onto a truck or the like for transportation or other purpose. In this manner, the tree trunks or logs do not rest against the ground which might encourage rot or decay, and which may cause damage or injury, should the logs inadvertently roll to another location. Likewise, the use of several log racks makes separating the species or sizes of logs much easier.

DETAILED DESCRIPTION OF THE PREFERRED EMBODIMENT AND OPERATION OF THE INVENTION

Figure 1:
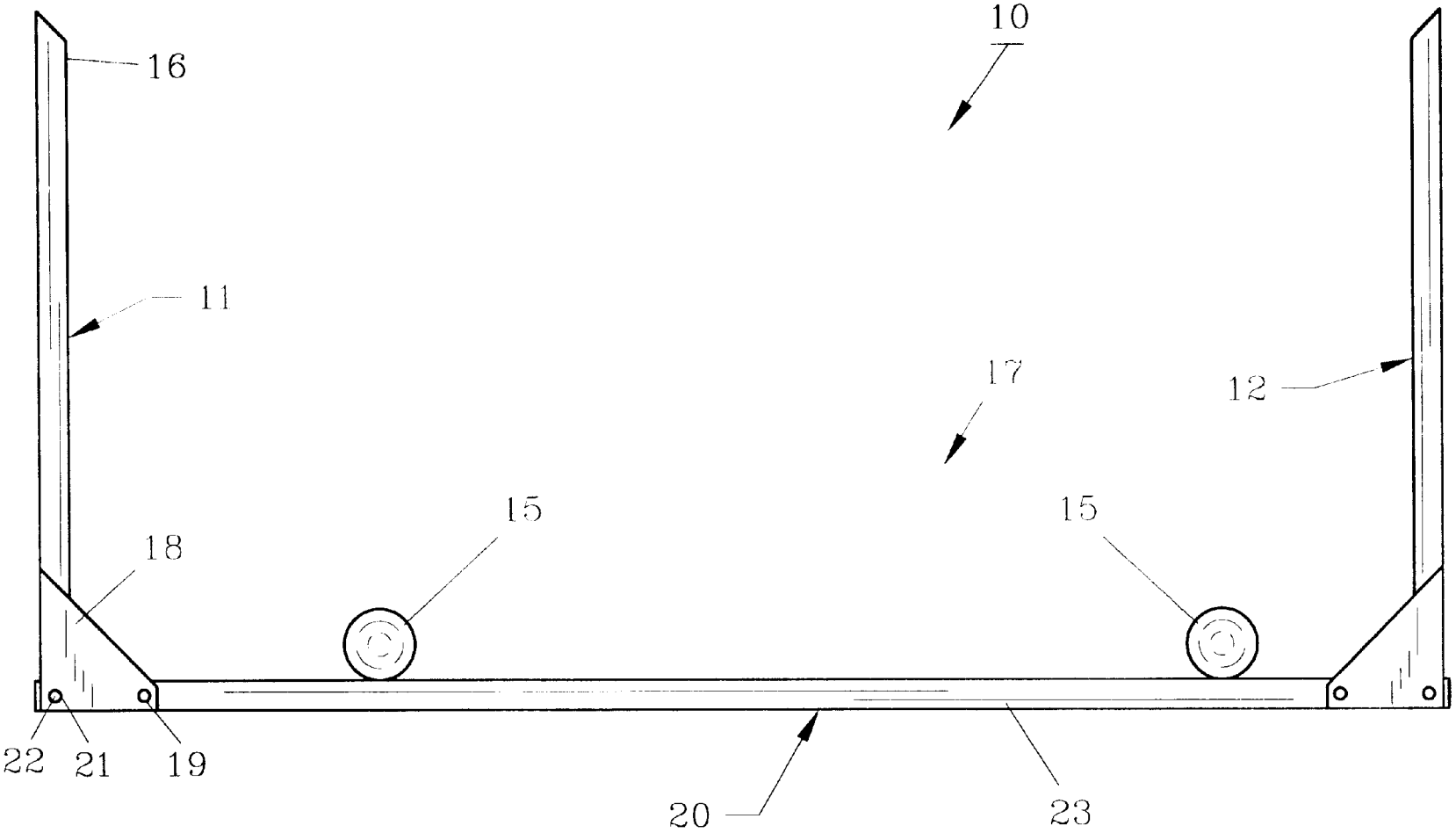
FIG. 1 shows a side view of the preferred embodiment of the present invention with the standards in the unfolded or extended position.
Figure 3:
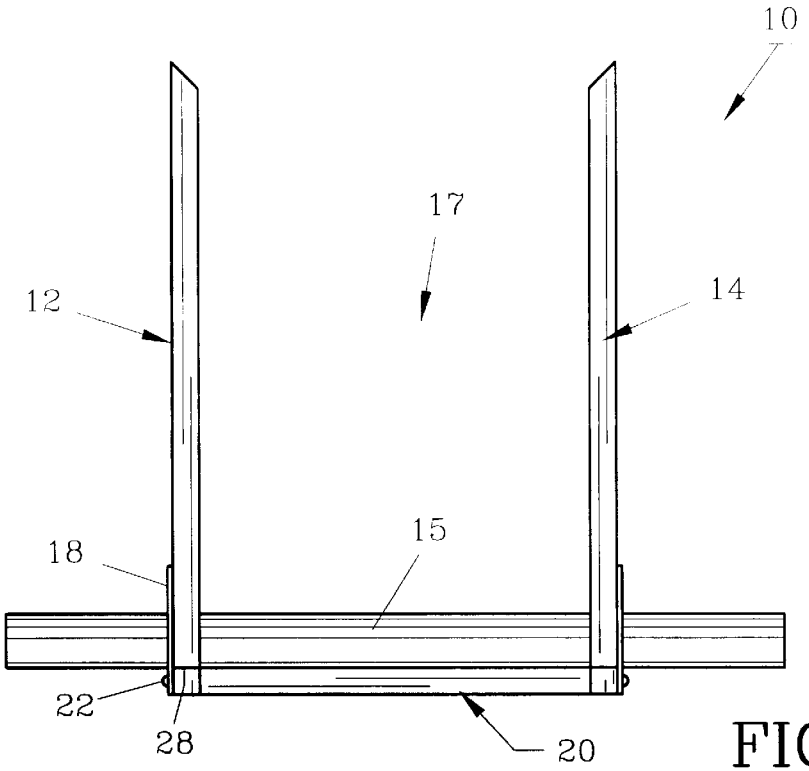
FIG. 3 demonstrates an end view of the log rack of FIG. 1.

Turning now to the drawings, specifically FIG. 1 shows preferred foldable log rack 10. Log rack 10 includes standards 11–14 (see also FIG. 4), which in FIGS. 1 and 3, are in their extended position and ready to receive log 15. Log 15 may be a trimmed tree trunk, a limb or other elongated article or articles as desired. Terminal end 16 of standard 11 is inwardly tapered so that log 15 may more easily be inserted by a conventional loader (not shown). (Inwardly as used herein means that the higher edges are exterior of log holding area 17, and the lower edges are proximate log holding area 17.) Note that each standard 11–14 includes a tapered terminal end, but since all standards are substantially identical, only one is described. Steel guide plate 18 is welded to standard 11 and is generally triangularly shaped. Hinge 19 allows steel plate 18 to pivot relative to base 20. Steel guide plate 18 defines locking pin hole 21 which receives conventional locking pin 22 to rigidly hold standard 11 in its extended position as shown in FIG. 1. It should be noted that each standard 11–14 is hingedly attached to base 20 by a triangular steel plate such as guide plate 18 and hinge 19. Guide plate 18 insures proper rotation of standard 11 from a collapsed to an extended position.

Figure 2:
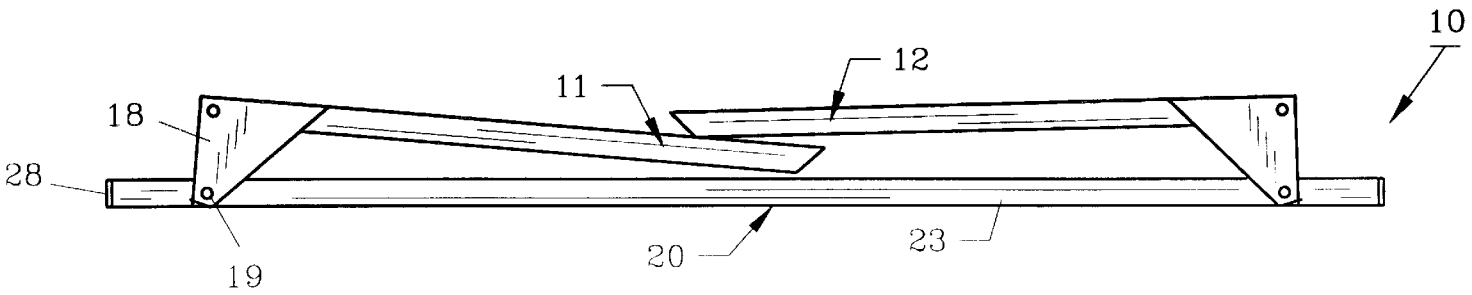
FIG. 2 illustrates the side view of FIG. 1, with the standards in the folded or collapsed position.

In FIG. 2, standards 11–14 are seen in their folded position with locking pin 22 removed. In their folded positions, at least two of standards 11–14 lie generally flush against or contiguous to base 20, with the remaining two slightly overlapping the first two and contiguous to the same. Flush herein means that standards 11–14 come into contact with base 20 for at least a portion of their length. While, this flush arrangement is not required, this positioning allows log rack 10 to be folded to a smaller size. Shorter standards 11–14 are contemplated so that all four standards 11–14 could lie flush against base 20. It can be seen that standards 11–14 all fold independently inwardly parallel to longitudinal member 23 of base 20. Standards 11–14 are preferably nine to ten feet (2.74 or 3.048 m) in length, but other dimensions are possible.

Figure 4:
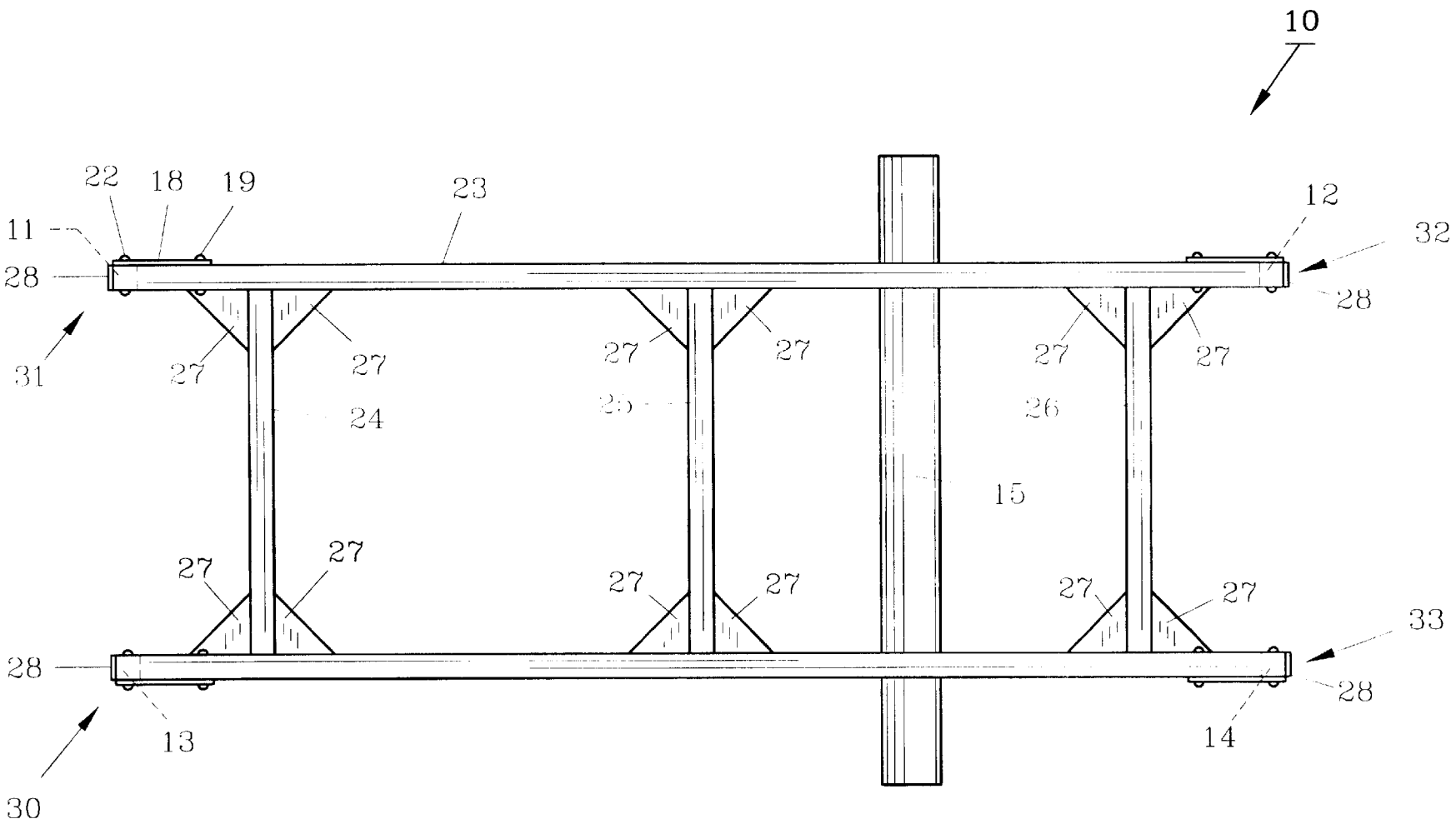
FIG. 4 features a bottom plan view of the log rack of FIG. 1.

As seen in FIG. 4, base 20 comprises longitudinal members 23 and 23' which are parallel to each other and perpendicular to transverse members 24–26. Longitudinal members 23 and 23' form corners 30–33, which are preferably capped by end caps 28, although caps 28 are not required. End caps 28 protect users from inadvertent contact with possible sharp edges associated with the ends of longitudinal members 23 and 23' and are preferably 1.27 cm thick steel caps, but other materials or thicknesses are acceptable. Transverse members 24–26 lie in the same plane as longitudinal members and are formed from 4"×4" by 80" long (10.16 cm×10.16 cm×203.2 cm) steel tubing. Transverse members 24–26 are connected to longitudinal members 23 and 23' by welding or the like, and reinforced by braces 27 which are formed from 1.27 cm thick steel plates. Braces 27 are generally planar and triangular and provide additional strength for base 20. As seen in FIG. 1, logs 15 may be placed perpendicular to longitudinal members 23 and 23' or, while not shown, perpendicular to transverse members 24–26. Base 20 is preferably ten to twenty feet in length and approximately eighty inches or 2.032 m in width. These dimensions allow the jaws of a conventional loader to easily manipulate logs 15 as desired during insertion and extraction of logs 15 from log holding area 17.

The preferred method of using log rack 10 comprises transporting log rack 10 by truck or the like in its collapsed or folded position to a desired location such as a logging area. Log rack 10 is placed on a generally level, cleared patch of ground large enough to receive log rack 10 and any logs 15 which may extend outwardly therefrom. Standards 11–14 are then rotated or raised into their extended, upright positions. Once standards 11–14 are in their extended positions, locking pins such as locking pin 22, are manually placed in all four (4) corresponding locking pin holes, such as locking pin hole 21, to secure standards 11–14 in the desired position. Meanwhile, loggers proceed into the forest or woods and select trees to be trimmed. This may be done through a clear cutting methodology, or given the environmental concerns associated with clear cutting, through a selective tree harvesting methodology as is understood. The trees are then cut down with a chain saw or other conventional device. Once selected and cut down, the trees are topped and trimmed whereby limbs and branches too small for use are removed. The remaining trimmed trunk, or other large branch, such as log 15, is then moved, by dragging or the like, as is conventional, to the cleared patch of ground where log rack 10 awaits. Logs or trimmed tree trunks 15 are then placed on log rack 10 by a loader or other means. In the event of slight misplacement, tapered terminal ends, such as terminal end 16, slide the log into log holding area 17 on log rack 10. Several log racks 10 may be used for large numbers of logs 15 or where it is desirable to separate logs 15 by species or size. Logs 15 are thus conveniently stored spaced from the ground by base 20, without danger of inadvertent rolling which may cause injury or other damage. When desired, logs 15 may be removed from log rack 10 and placed on a truck or the like (not shown) for transportation to a mill or other ultimate destination. After this step, log rack 10 may be reused, or standards 11–14 may be lowered or folded to their collapsed state and log rack 10 transported by truck to another location for reuse.

The preceding recitation is provided as an example of the preferred embodiment and is not meant to limit the nature or scope of the present invention or the appended claims.

I claim:

1. A log rack and a tree trunk in combination, said tree trunk comprising an elongated portion, said log rack comprising:

a) a base; and b) a plurality of foldable standards, said standards hingedly attached to said base, wherein each of said standards has an extended position and a folded position, wherein said tree trunk is selectively positioned on said base between said standards when said standards are in said extended positions.

2. The combination of claim 1, wherein each of said standards, in its extended position, is perpendicular to said base.

3. The combination of claim 1 wherein each of said standards, in its folded position, is flush against said base.

4. The combination of claim 1 wherein said base is planar.

5. The combination of claim 1 wherein said combination is formed from steel.

6. The combination of claim 1 further comprising a guide plate, said guide plate attached to one of said standards.

7. The combination of claim 1 wherein said base is generally rectangular, and each of said plurality of standards is generally positioned at different ones of the corners of said base.

8. The combination of claim 7 further comprising:

a number of plates equal to the number of standards, each one of said plates attached to different ones of said standards; and a locking pin, said locking pin releasably securing one of said plates to said base in a fixed position; and said standards each including a tapered terminal end.

9. A method of storing logs in a log rack having a base and a plurality of hingedly attached standards; each of said standards having an extended position and a folded position, said method comprising the steps of:

a) placing the log rack in a desired storage position;

b) raising said hingedly attached standards to their extended positions; and c) placing a trimmed tree trunk in said log rack.

10. The method of claim 9 further comprising the steps of removing the trimmed tree trunk from said log rack; and lowering said hingedly attached standards to their folded positions.

11. The method of claim 9 further comprising the step of locking said standards in their extended positions.

12. The method of claim 9 further comprising transporting said log rack to a desired location prior to raising said standards.

* * * * *